US007114584B2

(12) United States Patent
Burns et al.

(10) Patent No.: US 7,114,584 B2
(45) **Date of Patent: *Oct. 3, 2006**

(54) HOLLOW AUGER HEAD ASSEMBLY

(75) Inventors: Raymond W. Burns, Bethalto, IL (US); Anthony James Regna, De Soto, MO (US)

(73) Assignee: Good Earth Tools, Inc., Crystal City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/199,279

(22) Filed: Aug. 8, 2005

(65) Prior Publication Data

US 2006/0000647 A1 Jan. 5, 2006

Related U.S. Application Data

(63) Continuation of application No. 10/799,496, filed on Mar. 12, 2004, now Pat. No. 6,951,258, which is a continuation of application No. 10/183,212, filed on Jun. 27, 2002, now Pat. No. 6,739,411.

(51) Int. Cl.
*E21B 10/44* (2006.01)

(52) U.S. Cl. ..... 175/394; 175/395

(58) Field of Classification Search ..... 175/57, 175/323, 385, 394, 395
See application file for complete search history.

(56) References Cited

U.S. PATENT DOCUMENTS

| | | | | |
|---|---|---|---|---|
| 2,111,785 | A | 3/1938 | Kittrell | |
| 2,401,250 | A | 5/1946 | Kandle | |
| 3,207,242 | A | 9/1965 | Miller | |
| 3,414,690 | A | 12/1968 | Petersen | |
| 5,158,147 | A | 10/1992 | Pavey et al. | |
| 5,377,773 | A | 1/1995 | Tibbitts | |
| 5,427,191 | A | 6/1995 | Rickards | |
| 5,460,232 | A | 10/1995 | Burns et al. | |
| 5,476,149 | A | 12/1995 | Rickards | |
| 5,497,843 | A | 3/1996 | Burns et al. | |
| 5,655,613 | A | 8/1997 | Lauermann et al. | |
| 5,996,714 | A | 12/1999 | Massa et al. | |
| 6,129,163 | A | 10/2000 | Hamilton et al. | |
| 6,158,534 | A | 12/2000 | Fanuel | |
| 6,176,332 | B1 | 1/2001 | Massa et al. | |
| 6,371,702 | B1 | 4/2002 | DeWald, Jr. et al. | |
| 6,739,411 | B1 * | 5/2004 | Burns et al. | 175/57 |
| 6,951,258 | B1 * | 10/2005 | Burns et al. | 175/57 |

FOREIGN PATENT DOCUMENTS

GB 2 246 379 A 1/1992

* cited by examiner

*Primary Examiner*—William P. Neuder
(74) *Attorney, Agent, or Firm*—Storm LLP; John J. Patti; Mark D. Perdue

(57) ABSTRACT

A hollow auger head assembly for penetrating geological formations that utilizes drill bit assemblies to which both blades and finger bits are attached. The method of securing the individual drill bit assemblies to the auger head reduces incidents of the drill bit assembly becoming detached from the auger head during drilling operations. Additionally, a rust-resistant attachment mechanism is used attach the drill bit assemblies to the auger head, which makes the drill bit assemblies easier to remove and replace. The configuration and arrangement of the bits improves cutting efficiency, increases wear life and reduces the likelihood of the bits breaking during operation.

9 Claims, 4 Drawing Sheets

HOLLOW AUGER HEAD ASSEMBLY

CLAIM OF PRIORITY

This application is a continuation of U.S. patent application No. Ser. No. 10/799,496 entitled "HOLLOW AUGER HEAD ASSEMBLY," filed on Mar. 12, 2004, now U.S. Pat. No. 6,951,258, which is a continuation of U.S. patent application Ser. No. 10/183,212, now U.S. Pat. No. 6,108,637, entitled "HOLLOW AUGER HEAD ASSEMBLY," filed on Jun. 27, 2002 for inventors/applicants Raymond W. Burns and James Regna.

BACKGROUND

Rotary earth drills are commonly used in drilling operations, especially for drilling holes and conducting subsurface soil testing. These drills utilize drill bits to cut away soil and rock which is then removed from the drilling area up the shaft. Frequently, drill bits break, or lose their edge with age and use, and when they cease to be effective in removing soil or rock, the drilling operation must be stopped, the drill removed and the bits replaced. Therefore, it is desirable to utilize drill bits that retain their edge for the longest possible duration to reduce the occurrence of bit replacement.

Additionally, after drill bits have been used in drilling operations, it is often difficult to remove them from the heads. This is especially true because it is desirable to perform replacements on site, which is typically in a remote area with limited resources. Some mounting methods have been used that simplify replacement, but result in an increased incident of drill bits coming detached from the head during drilling operations.

Accordingly, a continuing search has been directed to the development of tools that are more rugged and durable that need to be replaced less frequently, drill earth with greater efficiency, and that can be replaced easily on site, when necessary.

SUMMARY

The present invention is directed to a rotary earth auger that utilizes drill bit assemblies to which both blades and finger bits are attached. The configuration and arrangement of the bits improves cutting efficiency, increases wear life and reduces the likelihood of the bits breaking during operation.

The individual drill bit assemblies have a self-locking hook configuration and are retained on the auger head by means of a unique sandwich mechanism to reduce incidents of the drill bit assembly becoming detached from the auger during drilling operations. Additionally, the drill bit assemblies are attached to the auger using an attachment method that resists rusting when the drill is in use, which makes the drill bit assemblies easier to remove from the drill when it is necessary to replace the bits.

The invention is a hollow auger head assembly for penetrating geological formations, comprising a hollow auger head configured such that it can be secured to a conventional auger used for drilling, and at least two drill bit assemblies secured to the hollow auger head. Each drill bit assembly comprises a drill bit body having a means of attachment, at least one finger bit secured to the underside of the drill bit body, and at least one blade secured to the front edge of the drill bit body.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
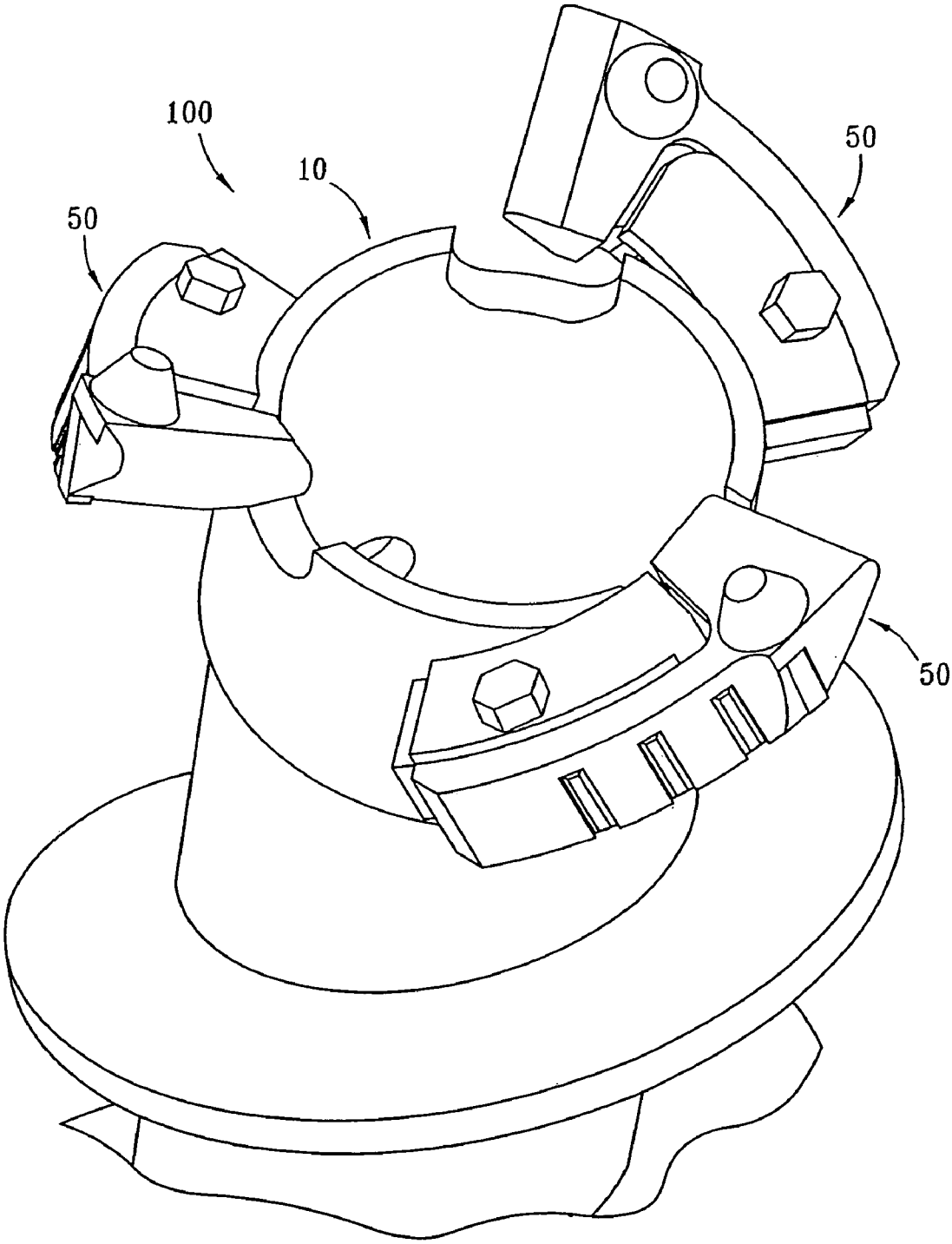
FIG. 1 is a bottom elevation view of a hollow auger head assembly embodying features of the present invention.

In the discussion of the FIGURES the same reference numerals will be used throughout to refer to the same or similar components. In the interest of conciseness, various other components known to the art, such as drilling components and the like have not been shown or discussed. Numerous specific details are set forth to provide a thorough understanding of the present invention. However, it will be obvious to those skilled in the art that the present invention may be practiced without such specific details.

Referring to FIG. 1 of the drawings, the reference numeral 100 generally designates the hollow auger head assembly of the present invention. The assembly 100 includes a hollow auger head 10, and one or more drill bit assemblies 50.

Figure 2:
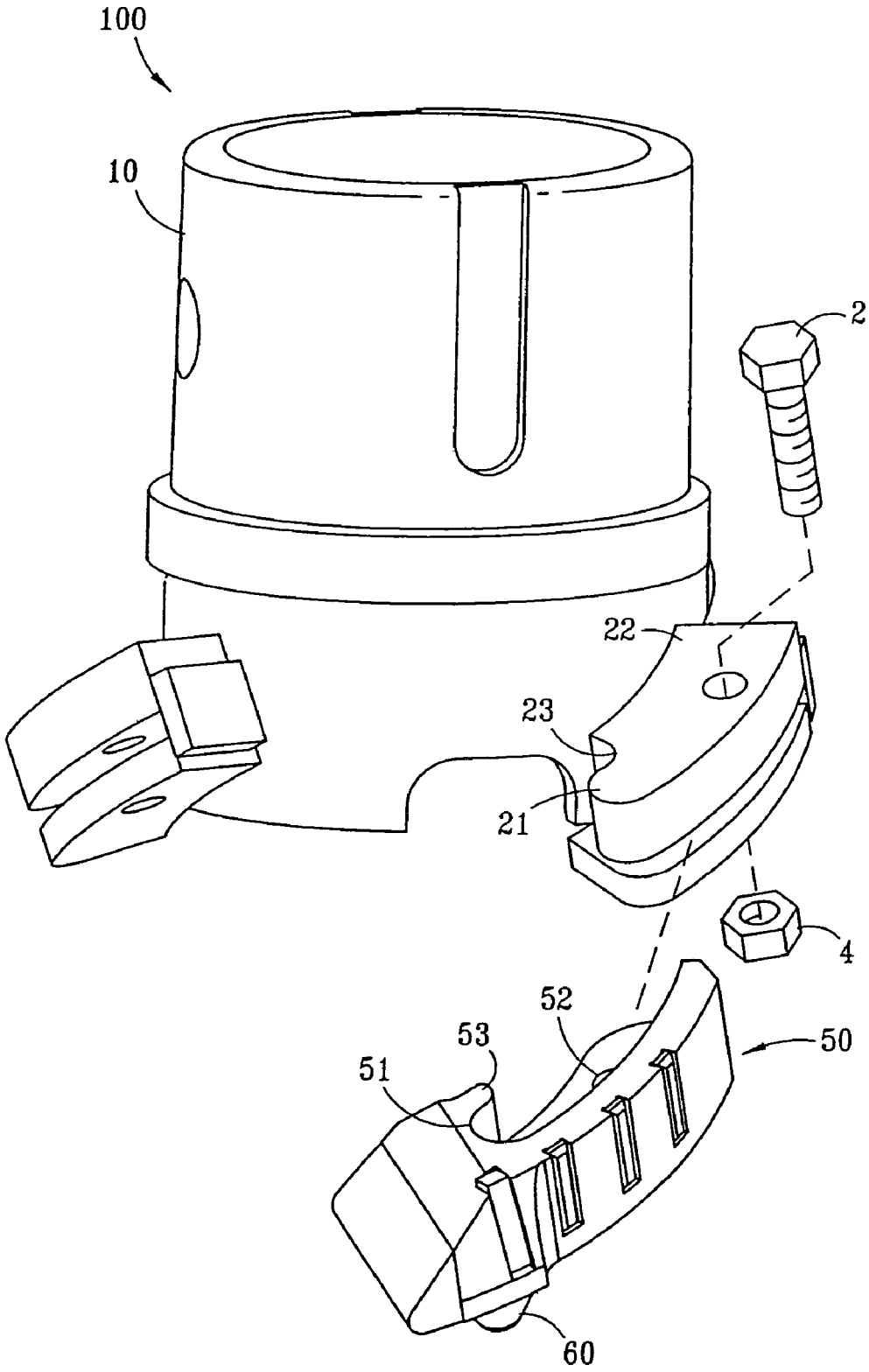
FIG. 2 is a partially exploded view showing assembly of the parts of a hollow auger head assembly of the present invention.

FIG. 2 shows the assembly of the parts that comprise the hollow auger head assembly 100 of the present invention. Each drill bit assembly 50 is secured to the hollow auger head 10. In a preferred embodiment of the present invention, the securing method comprises a rust-resistant bolt 2 and a rust-resistant nut 4, made of a material such as stainless steel. It will be obvious to those skilled in the art that the securing method can be other than a nut 4 and bolt 2; however, it is desirable to use a securing method that will keep the pieces securely together during use. Similarly, while the securing method can be made of any material, it is desirable to use materials that resist rusting so the drill bit assembly 50 can be easily detached from the hollow auger head assembly 100 after it has been in use in subterranean conditions.

Figure 3:
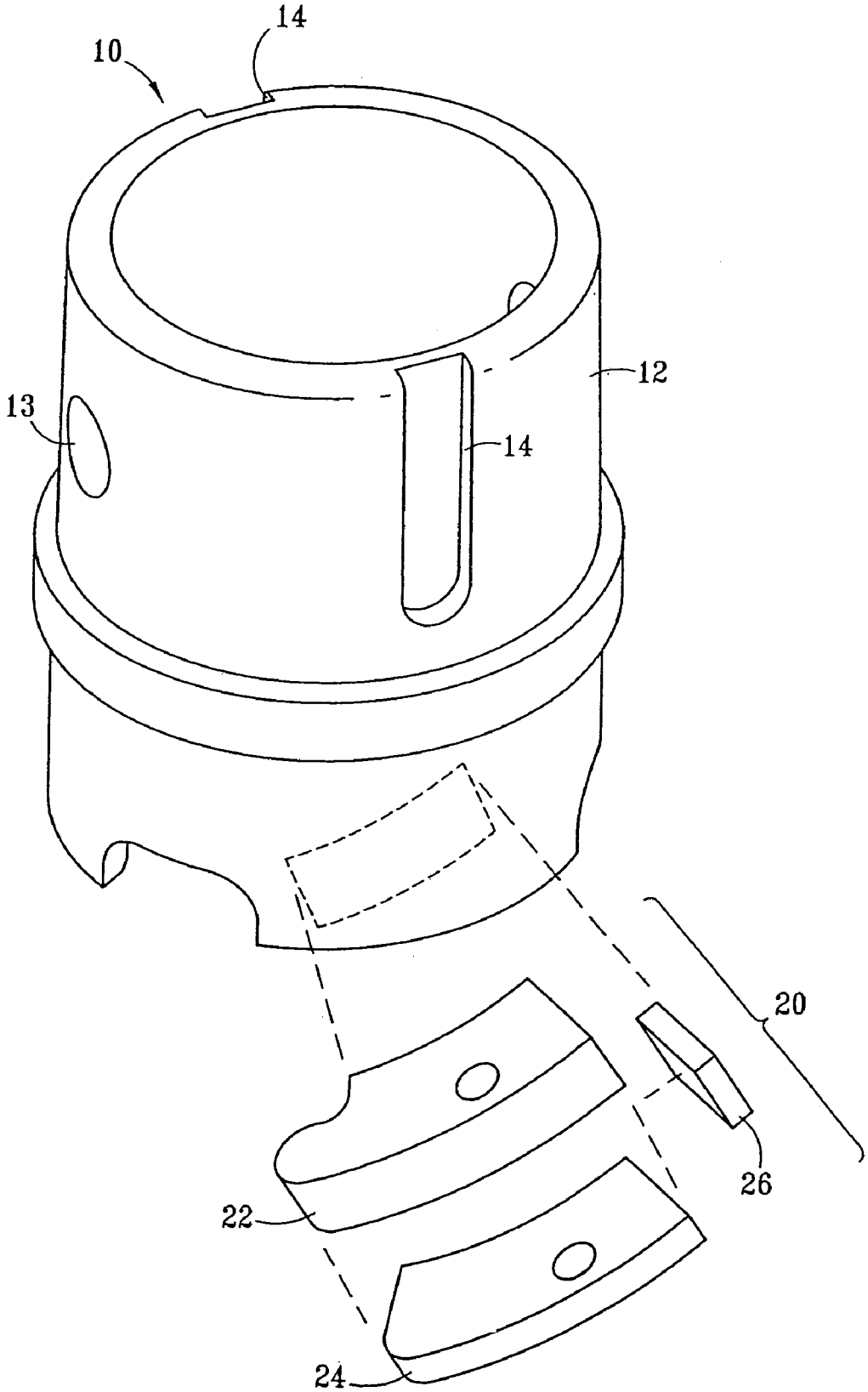
FIG. 3 is a partially exploded view showing assembly of the parts of a hollow auger head of the present invention.

FIG. 3 shows the parts of the hollow auger head assembly 100. The hollow auger head 10 comes in various sizes that correspond with standard size augers used in drilling operations so the hollow auger head assembly 100 can be used with standard drilling equipment. The number of drill bit assemblies 50 that will be used in a particular hollow auger head assembly 100 depends on, among other things, the size of the auger being used. Typically, at least two drill bit assemblies 50 are used on a hollow auger head assembly 100.

The hollow auger head 10 consists of an auger pin 12 to which two or more brackets, or sets of brackets 20, have been cast, or welded, soldered, or otherwise secured, depending on the number of drill bit assemblies 50 that will be used on that hollow auger head assembly 100. The sets of brackets 20 are positioned equidistant from each other around the circumference of the auger pin 12. The auger pin 12 is configured with through-material holes 13 and keyway grooves 14 such that it can be connected with conventional augers, and an auger key will fit into a keyway 14 on the auger pin 12.

In a preferred embodiment of the present invention, a set of brackets 20 is used to secure each drill bit assembly 50 to the auger pin 12. Each bracket set 20 consists of a top bracket 22, a lower bracket 24 and a back bracket 26, each of which is cast, or soldered or welded to the auger pin 12 along one side such that a gap exists between the top bracket 22 and lower bracket 24 of a size such that the drill bit assembly 50 can be inserted between the top bracket 22 and lower bracket 24. By positioning the drill bit assembly 50 between a top bracket 22 and a lower bracket 24, the drill bit assembly 50 is given greater security and is therefore less likely to break or become disconnected during use.

The drill bit assembly 50 is inserted into the gap between the top bracket 22 and lower bracket 24 and the holes in the brackets 22, 24 and drill bit assembly 50 are aligned. In a preferred embodiment, a bolt 2 is inserted through the holes in the brackets 22, 24 and drill bit assembly 50, and secured with a nut 4.

When the drill bit assembly 50 is properly positioned between the upper bracket 22 and lower bracket 24, the rear edge of the drill bit assembly 50 should be close to the back bracket 26. The back bracket 26 provides lateral stability for the drill bit assembly 50 when the hollow auger head assembly 100 is in use. This reduces the likelihood of the drill bit assembly 50 moving relative to the brackets such that the bolt 2 could become loose, or be subject to shear pressure such that it would break.

As shown in FIG. 2, the top bracket 22 has a front edge that has a sinusoidal shape comprising a protruding finger 21 and a recessed curved slot 23. The front edge of the top bracket 22 forms an interlock with the mirror image sinusoidal shape of the upper edge of the drill bit assembly 50. The finger 21 on the top bracket 22 fits snugly into the receptacle on 51 on the drill bit assembly 50, while the finger 53 on the drill bit assembly 50 fits into the receptacle 23 on the top bracket 22. Even if the bolt 2 were to become loose or break, this self-locking interlock would help ensure the drill bit assembly 50 stayed securely positioned in the top bracket 22.

FIG. 2 also shows the positioning of the bracket sets 20 on the hollow auger head 10, relative to the auger pin 12 and each other. The positioning of the bracket sets 20, and as a result the drill bit assemblies 50, on the hollow auger head 10 relative to each other is an important consideration in the functionality of the hollow auger head assembly 100. The arrangement of the drill bit assemblies 50 on the hollow auger head assembly 100 is such that the finger bit or bits 60 on a drill bit assembly 50 loosens material and feeds it to the blade 56 on the next drill bit assembly 50 on the auger head assembly 100 for further processing. Proper positioning of the drill bracket sets 20 on the hollow auger head 10 ensures that the drill bit assemblies 50 are properly positioned so that the loosened material is delivered to the blade 56 of the next drill bit head assembly 50 in an efficient manner.

In alternative arrangements of the present invention, a different number of brackets can be used to secure the drill bit assembly 50 to the hollow auger head 10. Similarly, brackets of a different shape can be used to secure the drill bit assembly 50 to the auger pin 12.

Figure 4:
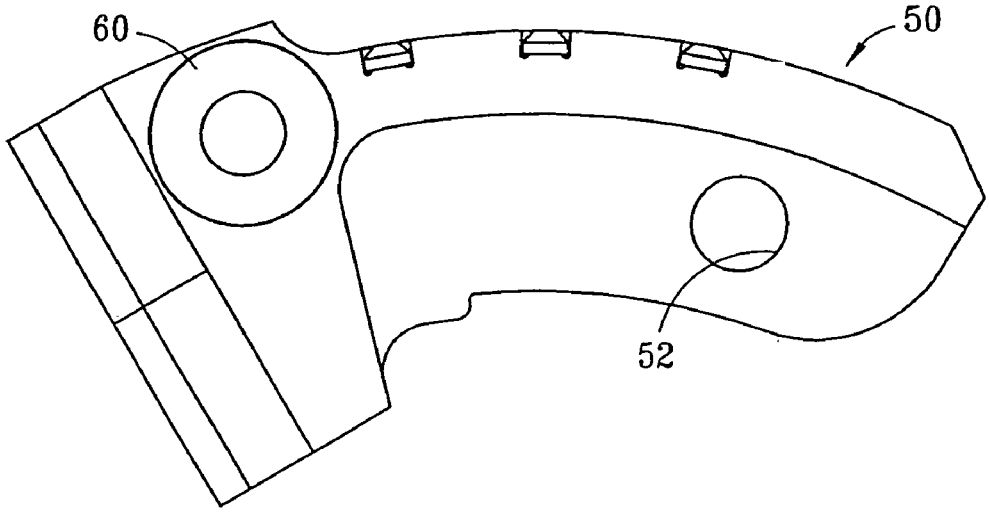
FIG. 4 is a view of the underside of a drill bit assembly of the present invention.

The underside of a drill bit assembly 50 is shown in detail in FIG. 4. The hole 52 for securing the drill bit assembly 50 to the bracket set 20 can be clearly seen. The drill bit assembly 50 shown has one conical finger bit 60 on the underside. However, depending on the particular configuration of the auger head assembly 100 being used, more than one finger bit 60 can be used. The finger bits 60 are designed so that when they are mounted on the drill bit assembly 50, the cutting edge of the finger bit 60 has a negative rake, or angle, relative to the movement of the hollow auger head assembly 100.

Because the cutting portion of the finger bit 60 contacts the geological material which it is drilling into at a negative angle, the cutting edge of the finger bit 60 is protected from excessive wear and cracking that would reduce the life of the finger bit 60. The negative angle relative to the geological material also reduces the impact between the finger bit 60 and the geological material, which reduces the wear on the finger bit 60 and the likelihood of damage to the finger bit 60.

Additionally, a layer of high-quality, wear-resistant metal, such as tungsten carbide or carbide coated metals may be bonded to at least the cutting edge of the finger bit 60 to increase the life of the finger bit 60. The layer of wear-resistant material may be secured to the finger bit 60 by means such as brazing or use of a bonding material, which bonds the finger bit 60 and wear-resistant materials together when heated.

In alternate arrangements of the hollow auger head assembly 100, finger bits 60 that are of a shape other than conical can also be used. The shape, number and position of the finger bits 60 used depends on the exact configuration and intended usage for the hollow auger head assembly 100.

Figure 5:
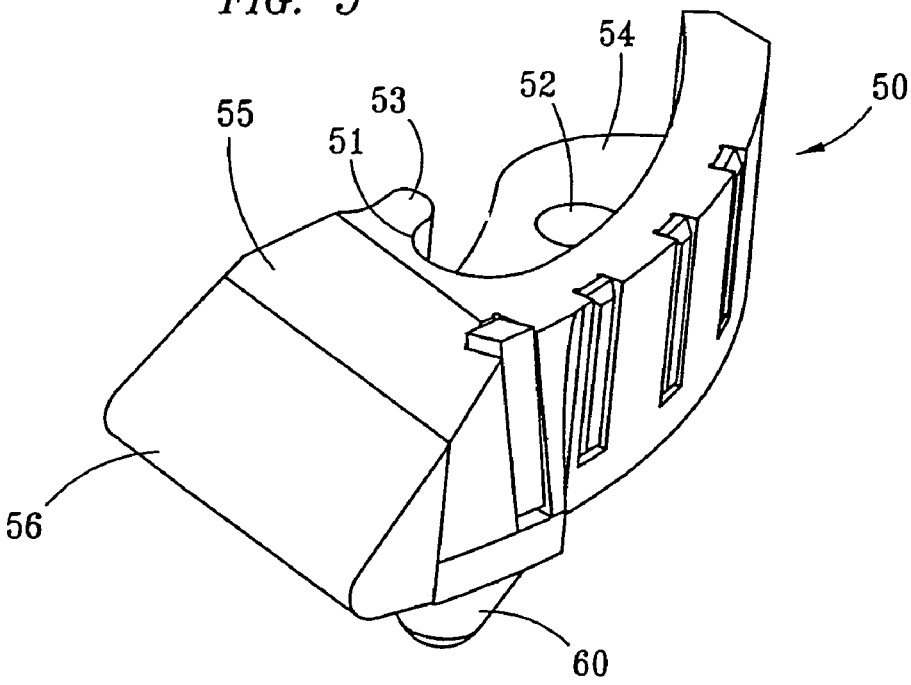
FIG. 5 is a detailed view of a drill bit assembly of the present invention.

FIG. 5 shows a detailed view of a drill bit assembly 50 of the present invention. The drill bit assembly 50 comprises a drill bit body 54, one or more finger bits 60, and a blade 56 secured along the front of the drill bit body. A hole 52 has been cut, reamed or drilled through the drill bit body 54 to allow insertion of a fastening mechanism so the drill bit assembly 50 can be secured to a bracket set 20.

The drill bit body 54 is shaped to have an inward facing receptacle 51 and a finger 53 along the top of the drill bit body 54. The finger 53 on the drill bit body 54 fits snugly into the receptacle 23 on the top bracket 22 of the hollow auger head 10, while a finger 21 on the top bracket 22 fits snugly into the receptacle on 51 on the drill bit body 54. The drill bit body 54 has a downward slope 55 from the receptacle 51 and finger 53 to the front edge of the drill bit body 54 where the blade 56 is secured. This slope 55 is useful in channeling processed geological material away from the blade 56 and up and out the auger.

The blade 56 is comprised of one or more pieces of hardened, wear-resistant material secured along the front edge or edges of the drill bit body 54. The blade 56 is usually made of wear-resistant metal, such as tungsten carbide or carbide coated metals which may be secured to the drill bit by means such as brazing or use of a bonding material which bonds the drill bit body 54 and blade 56 together when heated. The material can be sharpened as needed, and will retain the sharpened edge for an extended period of time. In some configurations of the drill bit assembly 50, hardened material is also placed along the front slope 55 of the drill bit body 54. In some configurations of the drill bit assembly 50, hardened material is also placed along the outer edge of the drill bit body 54 for cutting and processing of geological materials which come in contact with that edge of the drill bit assembly 50. The exact position and number of pieces of material on the drill bit body 54 depends on the specific arrangement and use of the hollow auger head assembly 100.

In operation, the hollow auger head assembly 100 is secured to an auger and used to drill into geological formations. The drill bit assemblies 50 are positioned around the hollow auger head 10 an appropriate distance from each other and in a proper alignment relative to each other. As the auger is rotated, the finger bits 60 on the drill bit assemblies 50 break up the geological material with which they come in contact. The negative angle of each finger bit 60 is such that the geological material it has broken up is fed back and up to the blade 56 of the next drill bit assembly 50 on the hollow auger head assembly 100. That blade 56, further processes and breaks up the geological material, and then feeds it up over the front slope 55 of the drill bit assembly 50, and subsequently up the auger and out of the drilling area.

Because a finger bit 60 on a drill bit assembly 50 feeds the blade 56 of the next drill bit assembly 50 on the hollow auger head assembly 100, positioning of the drill bit assemblies 50 on the hollow auger head assembly 100 relative to each other is critical. Further, the combination of finger bits 60 and blades 56 in a single assembly increases efficiency of breaking up and moving away of geological materials in the drilling operation.

It is understood that the present invention can take many forms and embodiments. Accordingly, several variations may be made in the foregoing without departing from the spirit or the scope of the invention. For example, the position, shape and number of finger bits 60 on a drill bit assembly can be varied. As another example, pieces of hardened material can be attached to the outside edge of the drill bit assembly by a variety of methods. These pieces of hardened material can assist in the breaking up of the geological formation being processed. The position, shape and number of pieces of hardened material can vary, and still be within the scope of the present invention. Yet another example is the number of pieces, shape and size of the pieces of hardened material affixed to the front of the drill bit assembly, which can be varied, but still fall within the scope of the present invention.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A hollow auger head assembly for penetrating geological formations, the hollow auger head assembly comprising:

a hollow auger head adapted to be secured to a conventional auger used for drilling;

at least two drill bit assemblies secured to the hollow auger head, wherein:

each of the drill bit assemblies includes an underside and a front edge;

each of the drill bit assemblies includes a finger bit secured to the underside of each of the drill bit assemblies; and each of the drill bit assemblies includes a blade secured to the front edge of each of the drill bit assemblies.

2. The apparatus of claim 1 wherein the blade is made of hardened material.

3. The apparatus of claim 1 wherein each drill bit assembly has an outside edge, the outside edge having pieces of hardened material secured thereto.

4. The apparatus of claim 1 wherein each finger bit is positioned on the drill bit body such that a cutting edge is at a negative rake angle to the front edge of the drill bit body.

5. The apparatus of claim 1 wherein hollow auger head hollow auger head assembly further comprises:

at least two bracket sets secured to the outside of the hollow auger head; and means for securing the each of drill bit assembly to one of the bracket sets.

6. The apparatus of claim 5 wherein the securing means for securing the drill bit assembly to the brackets comprises a bolt and nut made of a rust-resistant material.

7. The apparatus of claim 5 wherein the bracket set includes a back bracket, a lower bracket having at least one through-material hole, and an upper bracket having at least one through material hole;

the means for securing includes a protruding finger along a front edge of the drill bit body, and a recessed curved slot along a front edge of the bracket set; and wherein the protruding finger and the curved slot are adapted to be interlocked.

8. A hollow auger head assembly for penetrating formations, comprising:

a removable drill bit body having a finger bit and a blade; and a bracket set affixed to said hollow auger head for receiving said removable drill bit body.

9. The apparatus of claim 8 wherein the bracket set includes a back bracket, a lower bracket having at least one through-material hole, and an upper bracket having at least one through material hole, and a recessed curved slot along a front edge;

the drill bit body includes a protruding finger along the front edge; and the drill bit assembly has a drill bit body further comprising an inward facing protruding finger and a receptacle in opposite positions from the receptacle and finger on the upper bracket such that they can be wherein the protruding finger and the curved slot are adapted to be interlocked.

* * * * *